US005219617A

United States Patent [19]

Howard et al.

[11] Patent Number: 5,219,617

[45] Date of Patent: Jun. 15, 1993

[54] CORROSION RESISTANT COATED ARTICLES AND PROCESS FOR MAKING SAME

[75] Inventors: William J. Howard, St. Clair Shores; William E. Emmons, Troy, both of Mich.

[73] Assignee: Michigan Chrome and Chemical Company, Detroit, Mich.

[21] Appl. No.: 960,596

[22] Filed: Oct. 13, 1992

Related U.S. Application Data

[63] Continuation of Ser. No. 584,771, Sep. 19, 1990, abandoned, which is a continuation-in-part of Ser. No. 409,364, Sep. 19, 1989, abandoned.

[51] Int. Cl.[5] ..... C23C 4/00; C23C 26/00

[52] U.S. Cl. ..... 427/309; 148/268; 148/272; 148/284

[58] Field of Search ..... 427/309, 126.3; 148/268, 272, 284

[56] References Cited

U.S. PATENT DOCUMENTS

| | | | |
|---|---|---|---|
| Re. 28,015 | 5/1974 | Vermilyea et al. | 148/264 |
| Re. 29,827 | 11/1978 | Prust et al. | 148/264 |
| 1,811,298 | 6/1931 | Boulanger | 148/264 |
| 1,840,562 | 1/1932 | Bridges | 148/264 |
| 1,946,151 | 2/1934 | Edwards | 148/264 |
| 1,995,225 | 3/1935 | Raub | 148/264 |
| 2,035,380 | 3/1936 | Wilhelm | 148/264 |
| 2,059,801 | 11/1936 | Lindsay | 148/264 |
| 2,060,192 | 11/1936 | Gilbert | 148/264 |
| 2,106,227 | 1/1938 | Scharschu | 148/264 |
| 2,106,904 | 2/1938 | Wilhelm | 148/264 |
| 2,134,830 | 11/1938 | Michel | 148/264 |
| 2,438,877 | 3/1948 | Spruance | 156/626 |
| 2,440,969 | 5/1948 | Nightingall | 427/397.8 |
| 2,520,475 | 8/1950 | Sonnino | 148/268 |
| 2,680,081 | 6/1954 | Probert | 427/295 |
| 2,694,020 | 11/1954 | Tovee et al. | 427/58 |
| 2,719,796 | 10/1955 | Kappes | 427/309 |
| 2,796,371 | 6/1957 | Ostrander | 148/268 |
| 2,825,697 | 3/1958 | Carroll et al. | 148/264 |
| 2,832,705 | 4/1958 | Seidl | 427/126.3 |
| 2,843,513 | 7/1958 | Stricklen | 148/268 |
| 2,927,874 | 3/1960 | Pimbley | 148/265 |
| 2,976,193 | 3/1961 | Pimbley | 148/266 |
| 3,009,842 | 11/1961 | Steinbrecker | 148/268 |
| 3,066,055 | 11/1962 | Pimbley | 148/268 |
| 3,113,051 | 12/1963 | Pimbley | 148/268 |
| 3,130,061 | 4/1964 | McMahon et al. | 106/623 |
| 3,175,931 | 3/1965 | Burgess | 427/397.8 |
| 3,180,746 | 4/1965 | Patton et al. | 106/623 |
| 3,214,287 | 10/1965 | Mosna | 427/318 |
| 3,272,665 | 9/1966 | Romans | 428/403 |
| 3,347,713 | 10/1967 | Lodesen | 148/268 |
| 3,356,515 | 12/1967 | McGlothlin | 106/623 |
| 3,391,031 | 7/1968 | Russell | 148/267 |
| 3,400,021 | 9/1968 | Heinzelman | 148/264 |
| 3,404,043 | 10/1968 | Dell | 148/268 |
| 3,410,707 | 11/1968 | Pocock | 148/258 |
| 3,446,717 | 5/1969 | Farquhar et al. | 205/319 |
| 3,447,972 | 6/1969 | Wilde | 148/268 |
| 3,556,868 | 1/1971 | Ziemba | 148/264 |
| 3,592,747 | 7/1971 | Cohn | 427/309 |
| 3,625,737 | 12/1971 | Ricchezza | 148/272 |
| 3,832,239 | 8/1974 | Hoch et al. | 148/272 |
| 3,846,182 | 11/1974 | Huff et al. | 148/265 |
| 3,861,938 | 1/1975 | Jackson | 428/450 |
| 3,950,575 | 4/1976 | Kitayama et al. | 427/383.3 |
| 3,967,984 | 7/1976 | Helevig et al. | 148/264 |
| 3,969,127 | 7/1976 | Robitaille et al. | 106/425 |
| 3,973,998 | 8/1976 | Datta | 427/309 |
| 3,982,951 | 9/1976 | Palagos | 106/14.21 |
| 3,989,550 | 11/1976 | Newhard | 148/256 |
| 4,036,667 | 7/1977 | Simon | 148/268 |
| 4,070,193 | 1/1978 | Tucker | 148/264 |
| 4,141,758 | 2/1979 | Glassman et al. | 148/264 |
| 4,146,410 | 3/1979 | Reinhold | 148/268 |
| 4,200,475 | 4/1980 | Kasahara et al. | 148/264 |
| 4,328,046 | 5/1982 | Fuchs | 148/265 |
| 4,341,878 | 7/1982 | Marcantonio et al. | 524/3 |
| 4,365,003 | 12/1982 | Danforth | 428/552 |
| 4,509,254 | 4/1985 | Danrow et al. | 427/126.3 |
| 4,569,699 | 2/1986 | Hagans | 148/264 |
| 4,657,599 | 4/1987 | Sutherland | 427/397.7 |
| 4,810,300 | 3/1989 | Holcombe, Jr. et al. | 106/286.1 |
| 4,867,791 | 9/1989 | Jaklin | 106/74 |

FOREIGN PATENT DOCUMENTS

| | | | |
|---|---|---|---|
| 650790 | 10/1962 | Canada | 148/268 |
| 670925 | 9/1963 | Canada | 148/268 |
| 82476 | 5/1982 | Japan . | |
| 1174810 | 5/1966 | United Kingdom . | |
| 2078261 | 1/1982 | United Kingdom . | |

*Primary Examiner*—Michael Lusigan
*Assistant Examiner*—Vi Duong Dang
*Attorney, Agent, or Firm*—Harness, Dickey & Pierce

[57] ABSTRACT

Metallic articles, and method for making same, having a thin, adherent, chemically formed coating on their surface which preserves the uncoated article appearance and provides a unique combination of functional properties including resistance to chipping and flaking during elevated temperature use, resistance to corrosion from chemicals in the form of gases or aqueous acidic or alkaline solutions including salt spray, organic solvents, oils and vehicle fuels and suitability as a base for paint for parts within the engine compartment of vehicles.

6 Claims, No Drawings

CORROSION RESISTANT COATED ARTICLES AND PROCESS FOR MAKING SAME

This is a continuation of U.S. patent application Ser. No. 07/584,771, filed Sep. 19, 1990, now abandoned which is a continuation-in-part of Ser. No. 07/409,364 filed Sep. 19, 1989, now abandoned all having the same title "CORROSION RESISTANT COATED ARTICLES AND PROCESS FOR MAKING SAME."

BACKGROUND OF THE INVENTION

This invention relates to articles having integral chemically-formed surface coatings that provide an improved combination of adherence and corrosion resistant properties to such products and to a process for making same. More particularly, the articles of this invention have on their surfaces an integral, chemically-formed coating that is strongly adherent and resistant to chipping or flaking at elevated temperatures and provides to the product a unique combination of corrosion properties including commercially satisfactory resistance to oxidation during use in gases at elevated temperatures such as encountered in the engine compartments of vehicle engines, resistance to corrosion from humidity, from organic solvents such as ethylene glycol, oils and gasoline, from acidic or alkaline solutions such as salt spray to the extent that is required of a base for paint or other protective organic or water-based protective coating on parts used within the engine compartments of vehicles.

Chemical coatings on aluminum for various purposes including oxides, chromate-phosphates, chromates, and phosphates have long been known and have been commercially employed since the 1930's when the original Bauer-Vogel process of German patent 423,758 for chemically forming oxide coatings on aluminum was improved in 1937 by reducing the time required from hours to minutes but still produced only gray coatings at near boiling temperatures, see Aluminum, 1937, 19, 608–11 (hereby expressly incorporated by reference). Colorless oxide coatings suitable for a wider range of aluminum alloys were later developed but were less desirable as a base for paint than the Bauer-Vogel products and could not be successfully dyed, see Aluminum, 1938, 20, 536–8 (hereby expressly incorporated by reference). Chromate-phosphates were developed in the 1940's as paint base coatings and disclosed in U.S. Pat. No. 2,438,877 and later modified as disclosed in British Patent 1,114,645 and French Patent 1,477,179 (all of which are hereby expressly incorporated by reference). Chromate processes developed during the 1960's and 1970's have been asserted to provide improved paint bases relative to the chromate-phosphate coatings and are disclosed in a number of United States patents, including U.S. Pat. Nos., 3,009,482, 3,391,031, 3,404,043, 3,410,707, 3,447,972, 3,446,717, 3,982,951, 4,036,667, 4,146,410 and British Patent 1,409,413, all of which are hereby expressly incorporated by reference. A number of additional patents discuss various types of chemical coatings, protective layers or processes, and include U.S. Pat. Nos. Re. 28,015, Re. 29,827, 1,811,298, 1,840,562, 1,946,151, 1,995,225, 2,035,380, 2,059,801, 2,060,192, 2,106,227, 2,106,904, 2,134,830, 2,440,969, 2,680,081, 2,694,020, 2,825,697, 3,175,931, 3,214,287, 3,400,021, 3,950,575, 3,967,984, 3,982,951, 4,070,193, 4,141,758, 4,200,475, 4,341,878, 4,569,699, and 4,657,599, all of which are hereby expressly incorporated by reference.

Even though extensive development of chemical coatings for aluminum and its alloys has resulted from worldwide research efforts each heretofore known process and product present some problem or lack a particular set of properties needed for use in specific applications. Thus, there is a continuing need for other efficient, low cost processes for providing corrosion resistant coatings on aluminum and its alloys to satisfy specific commercial needs. For example, there are needs for uses other than bases for paints or other organic finishes, other needs for coating aluminum alloy substrates which contain alloy constituents known to hinder coating formation on alloys such as magnesium, silicon, copper, chromium and manganese. There remains a need for coating aluminum alloy sand castings which contain silicon, copper and magnesium and may contain other heavy metals such as nickel, chromium, titanium or silver to provide coatings that resist thermal and gaseous engine fume degradation and development of localized white corrosion products during long periods of use such as in commercial truck and automobile engine compartments. There also remains a need for improved coatings for zinc-based, cadmium-based, and magnesium-based materials.

The present invention provides articles that are coated with a new integral coating that results in good corrosion resistance and resistance to dislodgment during use in environments, such as vehicle environments. This invention also provides an economic, continuous process for producing the new coated articles of this invention, as will be described hereinafter.

SUMMARY OF THE INVENTION

In accordance with the present invention, articles are coated with a new, thin colorless coating, which preserves the appearance of the uncoated articles. In a first preferred embodiment, the coating contains as its essential component a chemical complex of alkali metal-chromium-silicates as defined in the claims. In an alternative second preferred embodiment, the coating contains as its essential components a "water glass" complex of alkali metal-silicates and water; a metallic oxide; and a lithium-containing compound. The amount of the essential components in the coating in each preferred embodiment is that which is sufficient to provide the coated articles with an unexpectedly unique combination of properties of appearance, adherence, resistance to chipping and flaking, corrosion resistance to acidic and alkaline gases and aqueous solutions and oils, solvents and fuels, and is sufficient to make it suitable as a surface treatment, such as a base for paint and the equivalent of paint on parts within the engine compartment of vehicles. The preferred coatings are colorless and so thin as to be virtually invisible to the naked eye. The coating thickness varies from about 50 angstroms, or 0.0005 micron, to about 2 microns.

This invention also provides a process for the continuous, efficient production of the improved coated articles of this invention. The continuous process makes use of known production line dip or spray apparatus in which the articles or parts to be coated are mounted on racks or in rotating barrels supported on conveyor means capable of sequentially contacting the articles with aqueous solutions positioned in a plurality of in-line tanks, each tank containing an aqueous solution of selected coating-producing ingredients with intervening rinse solution-containing tanks, the in-line apparatus terminating in conventional means for drying the coated parts. The process of this invention has the advantages of using dilute aqueous solutions of inexpensive, commercially available chemicals that are maintained at low treatment bath temperatures ranging from ambient room temperatures up to about 160° F., or 71° C., and for short times of contact of the solution with the article being coated, for example, by immersion contact in the range of about 20–180 seconds, preferably about 30 seconds, or spray contact for about 10 to 60 seconds and preferably 5–20 seconds. Longer contact times are also possible. The end result is that the continuous production process provides a resultant product that is less expensive than most heretofore available corrosion resistant products.

The process of this invention is useful to form coatings on non-ferrous metals such as aluminum, zinc, cadmium, magnesium and many of their alloys that are commercially available as sand castings, plate, sheet, forgings or extrusions. Particularly good results have been obtained by using the process for coating vehicle engine manifolds made from sand cast aluminum alloys as described in Example I. Also, good results are obtained using the process for coating zinc plated steels such as described in Example V.

DETAILED DESCRIPTION OF THE INVENTION

In a first embodiment the new articles of this invention include articles fabricated from aluminum or an aluminum alloy which have on their surfaces a thin, adherent coating having a thickness up to about 2 microns comprising as its essential component a chemical complex of an alkali metal-chromium-silicate having proportions of each in the range, expressed as oxides in weight percent of:

$Na_2O$-9.9%–12.1%;

$Cr_2O_3$-4.1%–4.3%; and $SiO_2$-76.8%–91.2%.

In an alternative second preferred embodiment, the new articles of this invention include articles fabricated from aluminum, zinc, cadmium, magnesium or their alloys which have on their surfaces a thin adherent coating having a thickness up to about 2 microns, and comprising as its essential components a water glass complex, a metallic oxide, and a lithium-containing compound. Water glass complexes are known in the art and typically include an alkali metal-silicate (such as including $Na_2O$ and $SiO_2$) and water. Preferably the constituents of the water glass (e.g. $H_2O$, $Na_2O$ and $SiO_2$) are present at or near their art-disclosed levels, and more preferably are present such that the proportions of each, expressed in percent, by weight of the final bath composition (wherein "the final bath composition" refers to an aqueous solution in which the coating has been dissolved or dispersed) are:

$Na_2O$ in an amount of about 0.44 to about 0.82%, and more preferably about 0.63%;

$SiO_2$ in an amount of about 1.27 to about 2.37%, and more preferably about 1.82%; and $H_2O$ in an amount of about 2.29 to about 4.25%, and more preferably about 3.27%.

Accordingly, preferably the water glass complex is present in the coating composition in an amount of about 4 to about 7.44 percent, by weight of the final bath composition, and more preferably is present in an amount of about 5.72 percent by weight of the final bath composition.

The coating of the alternative second preferred embodiment further comprises a metallic oxide-containing compound, and preferably a molybdenum oxide compound such as that having the chemical formula $MoO_3$. In a highly preferred embodiment, the metallic oxide-containing compound, preferably $MoO_3$, is present in an amount of about 0.1 to about 1.0%, more preferably from about 0.5 to about 1.0% and still more preferably at about 0.50%, by weight of the final bath composition.

Preferably the coating of the present alternative second preferred embodiment further comprises a lithium-containing compound, and more preferably a lithium hydroxide monohydrate ($LiOH.H_2O$) compound. The lithium-containing compound, preferably $LiOH.H_2O$, is present in an amount of about 0.1 to about 1.0 percent, by weight of the final bath composition, more preferably about 0 5 to about 1.0 percent, by weight of the final bath composition, and still more preferably about 0.50 percent by weight of the final bath composition.

Of course, the skilled artisan will appreciate that different concentrations than those set forth above are possible, particularly where concentrates containing the coating are involved.

The coating of the present alternative second embodiment, as well as the first embodiment described herein, is useful for coating articles made from aluminum or its alloys. The coating of the present alternative second embodiment also unexpectedly improves corrosion resistance of articles made from non-ferrous materials such as zinc, cadmium, magnesium and their respective alloys. The coating is especially useful as applied over steel articles plated (using conventional techniques) with zinc, cadmium or their respective alloys.

The process for making the coated new articles of this invention using the composition of the first preferred embodiment comprises the following sequential steps, omitting intervening water rinsing steps:

1) cleaning with an acidic cleaner to remove foreign matter, oils, greases or surface remnants from the forming of the article;
2) contacting the cleaned article from step 1 with an aqueous, strongly acidic solution capable of removing surface aluminum oxides;
3) contacting the clean, rinsed, substantially oxide-free article of step 2 with an aqueous acidic solution for forming a chromium-silicate-containing adherent surface coating;
4) elevated temperature water rinsing of the step 3 coated article;
5) contacting the rinsed coated article of step 4 with an aqueous, strongly alkaline solution capable of forming an alkali metal-chromium silicate coating containing a chemical complex having the composition, expressed as oxides in percent by weight of:

$Na_2O$-9.9%–12.1%;

$Cr_2O_3$-4.1%–4.3%; and $SiO_2$-76.8%–91.2%.

A preferred method for coating articles using the composition of the alternative second preferred embodiment comprises the steps of:

1) cleaning with an acidic cleaner to remove foreign matter, oils, greases or surface remnants from the forming of the article;
2) contacting the cleaned article from step 1 with an aqueous, strongly acidic solution capable of removing surface metallic oxides from the surface of the cleaned article;

3) contacting the clean, rinsed, substantially oxide-free article of step 2 with an aqueous acidic solution for forming an adherent surface coating;
4) elevated temperature water rinsing of the step 3 coated article;
5) contacting the rinsed coated article of step 4 with a solution (i.e bath) capable of forming a coating, wherein the coating is made by adding to water an admixture containing the following composition, expressed in percent, by weight of the final bath composition:
   - $Na_2O$ in an amount of about 0.44% to about 0.82%, and more preferably about 0.63%;
   - $SiO_2$ in an amount of about 1.27% to about 2.37%, and more preferably about 1.82%;
   - $H_2O$ in an amount of about 2.29% to about 4.25%, and more preferably about 3.27%;
   - $MoO_3$ in an amount of about 0.1% to about 1.0%, more preferably about 0.5% to about 1.0%, and still more preferably about 0.5%; and
   - $LiOH.H_2O$ in an amount of about 0.1% to about 1.0%, more preferably about 0.5% to about 1.0%, and still more preferably about 0.5%.

The following provides specific preferred details concerning the above methods of coating with the compositions of the first preferred embodiment and the alternative second preferred embodiment. The description that follows is of a process which is particularly preferred for use to coat articles of aluminum or aluminum alloy Nonetheless, the skilled artisan will appreciate that the methods are also useful for coating articles made from many other nonferrous materials such as zinc, cadmium, magnesium or their alloys In this regard, steps ordinarily taken to treat aluminum or aluminum alloys may be deleted or substituted with like steps known in the art for treating zinc, cadmium, magnesium or their alloys. Further, the skilled artisan will appreciate that techniques such as rinsing, oxide removal techniques and techniques for forming an adherent surface coating (e.g. chromating) are generally known in the art, and even though the following discussion constitutes a description of preferred techniques, such techniques can be substituted with any suitable known techniques, or the sequence of steps may be modified, for achieving the purpose stated.

Cleaning solutions suitable for use in the first step of the process include a wide variety of commercially available inhibited acidic cleaners. Good results are obtained by using an aqueous phosphoric acid solution containing phosphoric acid in an amount sufficient to give a pH in the range of about 5 to 6, and which may contain organic solvents such as tri- or diethylene glycol monobutyl ether in an amount of about 2% to 10% and may also contain any of a number of commercially available organic surfactants, for example, about 2% to 10% of a fluorocarbon surfactant such as PC 95 available under the tradename Fluorad from Minnesota Mining & Manufacturing Co. The parts to be cleaned are immersed in such a cleaning solution at a temperature of about 130° to 180° F. for 2 to 5 minutes, preferably about 3 minutes, followed by rinsing in water at a temperature of about 120° to 140° F., preferably about 130° F., for 30 to 90 seconds.

The cleaned articles from step 1 are then contacted with a stronger aqueous acidic solution capable of removing oxides from the surfaces of the article. Good results are obtained by using a chromic acid-based solution containing 70% to 80% chromic acid, 20% to 30% potassium dichromate and 2% to 4% ammonium silicofluoride in a concentration of 3 to 6 oz./gal., preferably about 4 oz./gal. to form a solution having a pH in the range of about 0.5 to 1 and contacting the article with such solution for a time period in the range of about ½ to about 3 minutes. The oxide free cleaned articles are then water rinsed in one to three water tanks at ambient temperatures, for about 30 seconds in each rinse solution.

The deoxidized, rinsed article is then subjected in step 3 to a coating forming step by contacting the article by dip or spray with a suitable aqueous solution to form a chromate coating, and preferably a silicon-chromate coating on the surface. Good results are obtained in forming such coatings by using an aqueous solution made up by adding to water, preferably deionized water, about 0.5–2.0 oz./gallon of a composition containing in weight percent about 50% to 60% chromic acid, about 20% to 30% barium nitrate and about 15–20% sodium silicofluoride and preferably containing a catalyst in an amount of up to about 5% such as an alkali metal ferricyanide, i.e., potassium or sodium ferricyanide to form a solution having a pH in the range of about 1.2–1.9 and preferably about 1.5. Other formulations which are also satisfactory for use may omit the barium nitrate component, and may include additional coating catalysts of the molybdic acid type in the event color is desired, such as the formulations disclosed in U.S. Pat. No. 3,009,842 (hereby incorporated by reference) and in the other patents identified therein. Other useful, but less desirable compositions that are suitable for coated articles having less stringent requirements for salt spray resistance include those set forth in U.S. Pat. Nos. 3,410,707 and 3,404,043, which are hereby incorporated by reference. Compositions that are satisfactory are commercially available from a wide variety of suppliers in the United States and especially good results are obtained by using the material commercially designated Iridit 14–2 which is available from Witco Chemical Company.

It is to be further understood that the proportions of the components in the preferred composition described above are not critical to the formation of the base coating that is formed directly on the oxide free surface of the metallic article being coated in accordance with this invention. Useful coated articles are formed when the formulation given above is varied to employ proportions within the ranges set forth in U.S. Pat. No. 3,982,951 (hereby incorporated by reference). When the article is dipped, an immersion time of about 30 seconds is adequate when the temperature is maintained at less than 120° F., or 49° C. When the article is sprayed at a similar temperature, about 5 to 20 seconds is adequate.

It is important to insure a thorough water rinsing of the coating formed in step number three. This is best done using deionized water at ambient temperature, i.e., about 60° F.–90° F., in 1 to 3 immersions, preferably three, for about 30 seconds each, or a single power spray for about 30 seconds. Following the thorough ambient temperature rinsing of the coated article from step 3, the fourth step is a final water rinse at a temperature that is higher than the ambient temperature employed in step 3. This higher temperature rinse serves to remove unwanted chromate colors, if present, and also to prepare the coating from step three to enhance its reactivity with the components in the strong alkaline solution to be next applied to form the coating of this invention. Preferred conditions for step 4 include using deionized water at a temperature in the range of about ambient to about 160°, and more preferably about 110° F. to 160° F., or about 43° C. to 71° C., and preferably about 130° F. or 54°-55° C. The coated article from step 3 should be rinsed at the selected temperature for a time sufficient to raise the temperature of the article to about the elevated temperature of the rinse solution. Thus, the optimum time required varies for specific articles depending on the selected composition used in step 3 and also depends on the size or bulk of the article. The optimum time may be affected by the particular alloy composition of the article being coated. For example, the time required may vary from about 30 seconds up to about 5 minutes, and the needed, or optimum, time is easily determinable by a few trials Where the article is formed by sand casting a metallic material, the article may include pits or surface imperfections. When such imperfections are present it has been found that potential, undesirable white corrosion products may develop in such pit or imperfection areas during salt spray testing or use and this undesirable corrosion can be avoided by exercising care in selecting a sufficiently high temperature toward the 160° F. limit and a sufficiently long time for the selected elevated temperature rinse step.

The elevated temperature rinsed coated article from step 4 is then subjected in step 5 to a second coating step by contacting the coated article with the coating composition of the first preferred embodiment, the coating composition of the alternative second preferred embodiment, or mixtures thereof.

When coated with the coating composition of the first preferred embodiment the coated article from step 4 is contacted with a highly alkaline aqueous solution having a pH in the range of about 10 to about 12, and more preferably about 11 to 12, and containing disodium oxide and silicon dioxide components having a weight ratio of $SiO_2/Na_2O$ in the range of about 2.4 to 3.25 and a range of densities between about 40 and 52 degrees Baume' at 20° C. Otherwise expressed the silicate solutions may contain in weight percent, about 26.5% to about 33.2% $SiO_2$ and about 8.6% to about 13.9% $Na_2O$, at a similar range of densities. Preferred solutions are those which contain disodium oxide and silicon dioxide in a weight ratio of $SiO_2/Na_2O$ of about 2.5 to 2.9 and a density in the range of about 42 to about 47 degrees Baume' at 20° C. The best results have been obtained from a solution formulated by adding to water an amount of about 2% to 6% by volume, and more preferably about 4.5%, of a sticky, heavy silicate having a weight ratio of $SiO_2/Na_2O$ of 2.9 and a density of 47° F. Baume' at 20° C. to thereby produce a coating solution having a pH of about 11.5.

When coated with a highly preferred coating composition of the alternative second preferred embodiment the coated article from step 4 is contacted with an aqueous solution or bath having a pH in the range of about 10.5 to about 12 being prepared from a water glass complex including disodium oxide, silicon dioxide, and water, having a weight ratio of $SiO_2/Na_2O/H_2O$ in the range of about 0.44 to 0.82 parts $Na_2O$: about 1.27 to about 2.37 parts $SiO_2$: about 2.29 to about 4.25 parts $H_2O$ and still more preferably about 0.63 parts $Na_2O$ to about 1.82 parts $SiO_2$ to about 3.27 parts $H_2O$, and a range of densities between about 40 and about 52 degrees Baume' at 20° C. The solution further comprises $MoO_3$ and $LiOH.H_2O$ present such that the weight ratio of $MoO_3$ to $LiOH.H_2O$ is about 1:1, and further wherein each of $MoO_3$ and $LiOH.H_2O$ are present in an amount of about 0.5 parts by weight to about 1.82 parts $SiO_2$, about 0.63 parts $Na_2O$, and about 3.27 parts $H_2O$.

Otherwise expressed (as percent, by weight of the final bath composition), a highly preferred final bath composition preferably includes the water glass complex having constituents present in an amount of about 0.63 percent $Na_2O$, about 1.82 percent $SiO_2$, and about 3 27 percent $H_2O$. The final bath composition further includes $MoO_3$ in an amount of about 0.5 percent, and $LiOH.H_2O$ in an amount of about 0.5 percent.

In a highly preferred embodiment the coated article from step 4 is contacted with an aqueous solution formed by adding to water an amount of about 2 to about 6 percent by volume of the final bath composition of a compound containing about 5.72 parts by weight water glass (i.e., about 0.63 parts by weight $Na_2O$; about 1.82 parts by weight $SiO_2$; and about 3.27 parts by weight water); about 0.5 parts by weight $MoO_3$; and about 0.5 parts by weight $LiOH.H_2O$.

The articles from step 4 are immersed for about 30 seconds to 2 minutes in the solution of step 5 at a temperature of ambient to about 130° F., with the solution having a preferred pH between about 11.2 and 11.5 when using the composition of the first embodiment, and a pH between about 10.5 and 12, when using the composition of the alternative second preferred embodiment. The thus coated articles are finally dried either in ambient air, by using clean forced air, or by placing them in a low temperature furnace at 150° to 200° F. for 1 to 2 minutes.

The dried, coated articles are the new articles of this invention. In their preferred form, the articles have a thin, adherent coating that is substantially invisible to the naked eye but has a thickness in the range of about 50 angstroms to about 20,000 angstroms, or about 0.0005 micron to about 2 microns. The coated article has the same overall appearance as the uncoated article unless a tint is intentionally produced by varying the composition of step 3 or the temperature of step 4 as will be readily apparent to those skilled in the art of forming chromate coatings.

Tests conducted on the articles coated with the composition of the first preferred embodiment have established that the coating is sufficiently adherent and hard to resist chipping or flaking when used at elevated temperatures up to about 400° F. such as may be attained in the engine compartments of automobiles and trucks, and even as high as about 1200° F. When the articles from step 5 using the composition of the first preferred embodiment were vehicle intake manifolds and were tested for salt spray resistance under the conditions of ASTM B-117 test method no corrosion products were visible for 250 hours.

Articles coated with the composition of the alternative second preferred composition exhibit no visible corrosion products for at least about 250 hours. For some applications (such as applied to panels of forged aluminum alloy 1100 treated with trivalent chromate) no corrosion products are visible for about 720 hours.

EXAMPLE I

Automobile intake manifolds were sand cast from a Ford Motor material designated 319 Aluminum having a specification of 5.5-6.5 Si, 0.4-0.6 Mn., 3.0-4.0 Cu, 0.1-0.6 Mg., 0.7-1.0 Zn and 1.0 Max Fe. The articles were mounted on racks carried by a dip-type conveyor adapted to dip the racks into tanks to form coated manifold articles of this invention in the following sequence of steps:

1) A tank of aqueous acidic cleaning solution was prepared to contain, in percent by weight, 5% of the commercial product Niklad Alprep 230[a]. The intake manifolds were dipped in the solution having a pH of 5-6 at approximately 130° F., for about 2 minutes;
2) water rinse at 130° F.±5° F., for about 30 seconds;
3) repeat step 2;
4) A tank of aqueous acidic coating solution was prepared by mixing about 1 oz. per gallon of Iridit 14-2[b] with water to form a solution having a pH of 1.4-1.5. The rinsed manifolds from step 3 were immersed in the solution for 30 seconds;
5) Water rinse at ambient room temperature of about 60° F.-90° F. for 30 seconds;
6) repeat step 5;
7) A tank of deoxidizing strongly acidic cleaner was prepared by mixing 4 oz./gallon of Deoxidizer No. 2[c] with water to form a solution having a pH of 0.5-1.0. The rinsed manifolds of step 6 were immersed in the solution for 90 seconds;
8) water rinse at ambient temperature;
9) repeat step 8;
10) repeat step 8;
11) repeat immersion for 3 minutes in the same solution as in step 4;
12) water rinse at ambient temperature;
13) repeat step 12;
14) repeat step 12;
15) water rinse, deionized water, at approximately 140° F.-150° F. for about 30-50 seconds.
16) A tank of strongly alkaline coating solution was prepared by mixing 4% by volume of Ultraseal[d] to form a solution having a pH of about 11.5. The manifolds from step 15 were immersed at a temperature of about 130° F. for about 30 seconds.
17) The coated manifolds from step 16 were drained and dried at ambient temperature.

[a]Available from Allied Kelite Division of Witco Chemical Co., Des Plains, Ill., containing phosphoric acid (75% strength), 20% butyl cellosolve, and 2% FC 95 Fluorad surfactant or equivalent from Minnesota Mining and Mfg. Co.
[b]Available from Witco Chemical Co. and containing in weight percent, 50%-60% $Cr_2O_3$, 20%-30% barium nitrate, 15%-20% sodium silicofluoride and 5% potassium ferricyanide.
[c]Available from Amchem Products Inc., Ambler, Pa., and containing, in weight percent, 70%-80% $Cr_2O_3$, 20%-30% potassium dichromate, and 2%-4% ammonium silicofluoride.
[d]Available from MacDermid Inc., Waterbury, Conn. and containing, by weight, 31.6% $SiO_2$, 11% $Na_2O$. trace amounts of Lithium and Molybdenum and a density of 47 degrees Baume' at 20° C.

Coated articles from step 17 were analyzed using Electron Spectroscopy for Chemical Analysis (ESCA) to establish coating thickness and the elemental composition of the surface coating. The coating thickness of the dried articles from step 17 was greater than 50 angstroms and less than 2 microns.

An ARL SEMQ electron microprobe analysis using 10 KeV accelerating voltage and wave length dispersive spectrometry (WDX) established that the elemental surface coating on the rinsed article from step 6 contained 4.2% silicon, 0.6% chromium and 2.0% oxygen, and it was concluded to be majorly a silicon-chromate coating. The rinsed coating from step 14, which resulted from the second application of the same solution which produced the article from step 6, included increased quantities of silicon and chromium in the coating to 7.4% silicon, 1.1% chromium and 2.0% oxygen. After the rinsed and elevated temperature silicon-chromate coating of step 15 was contacted with the strongly alkaline solution in step 16 the final, dried coating was analyzed. The above identified electron microprobe and accelerating voltage was used. The coating composition, in weight percent, expressed as oxides of the detected elements and taking into account the applicable accuracy level of the use conditions of the analyzing equipment, contained:

9.9-12.1% $Na_2O$;
4.1-4.3% $Cr_2O_3$; and
76.8-91.2% $SiO_2$.

Articles were tested for salt spray resistance using ASTM B-117 test conditions and no corrosion products were visible after 250 hours. Other articles were tested under Engineering material Specification Number ESE-M2P128-A of Ford Motor Co. which is the specification of a superior quality of paint required on the engine, engine accessories and/or parts within the engine compartments of automobiles and trucks. Coated articles from step 17 of the above described process qualified as passing all of the requirements of a superior quality paint including adhesion, hardness, water resistance, gasoline resistance, hot oil resistance, glycol resistance, heat resistance and 96 hours salt spray resistance using the conditions of ASTM B-117.

The process was also used to coat other manifolds sand cast from the materials designated alloy 355.0 - T6, UNS Number A03550, and a die Cast aluminum alloy designated BS 1490-LM20 having a specification of 13.0 Si, 1.0 Iron, 0.5 Mn, 0.4 Cu, 0.2 Mg, 0.2 Zn, 0.1 Ti, 0.1 Ni, 0.1 Pb and 0.1 Sn.

Substantially similar results are obtained when the above process is used to coat articles made from zinc, cadmium, magnesium or their alloys.

While not intending to be bound by theory, it is believed that the steps above are unique in opening the "pores" on the surface of the metal, allowing the beneficial coating to impregnate these pores for more efficacious treatment and sealing of the metallic surface.

EXAMPLE II

Diode plates for automobile alternators that were stamped into the desired configuration using extruded aluminum alloy 6061-T6, AMS 4150G were coated using the process of this invention. The diode plates were approximately 5" long, ⅝" wide and ⅛" thick and in the shape of an arcuate segment of a circle having a radius of about 5 inches, and provided with a plurality of openings for receiving and supporting diodes.

A quantity of the stamped diode plates were positioned in rotatable barrels, as opposed to the racks described in Example I, and the barrels were sequentially processed through the same coating solutions used in Example I except that steps 4-6 were omitted and certain of the times of immersion in some of the other solutions were changed. In step 1 the immersion was for 3 minutes. In step 7, the immersion was for 2-3 minutes. In step 11, the silicon-chromate coating forming tank, the immersion time was 12 minutes and immersion time in the rinses in steps 12-15 was for a total of 5 minutes.

The coated diode plates retained the aluminum appearance of the stamped parts and were coated with an adherent, scratch and chip resistance coating having a thickness of approximately 2 microns.

The coated diode plates from step 17 were tested for their ability to continue to pass current when assembled into an automobile alternator that was positioned in a salt spray cabinet using the salt spray test conditions of ASTM B-117. The diode plates were found to resist salt spray corrosion and to continue to pass the test current without failure for 1000 hours.

EXAMPLE III

Manifolds of aluminum alloy SAE-331 (AA333)-F Temper are cast, coated with hexavalent chromate (bleached to colorless). The manifolds are then coated to a thickness of about 1-2 microns, by contacting the manifolds with an aqueous bath having therein a coating composition set forth in Table I (expressed as parts by weight of the final bath composition).

TABLE I

| Component | Parts by Weight |
|---|---|
| Water glass: | 5.72 |
| $Na_2O$ (0.63 parts by weight) | |
| $SiO_2$ (1.82 parts by weight) | |
| $H_2O$ (3.27 parts by weight) | |
| $MoO_3$ | 0.50 |
| $LiOH.H_2O$ | 0.50 |

Using salt spray test conditions of ASTM B117, 264 hours pass before the first sign of corrosion.

EXAMPLE IV

Forged panels of aluminum alloy 1100 having a composition of about 99.0%, by weight, aluminum are coated with trivalent chromate, and are coated to a thickness of about 1-2 microns with the composition of Table I in Example III. Using salt spray test conditions of ASTM B117, 720 hours pass before the first sign of corrosion. Substantially similar results are obtained with a hexavalent chromate coating.

EXAMPLE V

Three specimens (A,B,C) of a low carbon (e.g. AISI types 1018-1020 steel) steel are plated with zinc to a thickness of about 0.0003" to about 0.0005". Specimen A is yellow chromate coated. Specimen B is black chromate coated. Specimen C is clear chromate coated.

Specimens A, B and C are each coated to a thickness of about 1-2 microns with the composition of Table I in Example III. Using salt spray test conditions of ASTM B117, 384 hours pass before the first sign of corrosion in specimens A and B; and 336 hours pass before the first sign of corrosion in specimen C.

Substantially similar results are obtained with cadmium plated materials. While the above description constitutes the preferred embodiments of the present invention, it will be appreciated that the invention is susceptible of modification, variation and change without departing from the proper scope and fair meaning of the accompanying claims.

What is claimed is:

1. A method for forming a clear, thin, colorless, adherent coating on the surfaces of aluminum or aluminum alloy articles wherein said coating has a thickness in the range of about 50 angstroms to about 2 microns which consists essentially of the steps of:
   1) cleaning said aluminum article in an aqueous acidic solution;
   2) removing oxides from the surfaces of the article from step 1 by contact for up to about 3 minutes with an aqueous solution having a pH in the range of about 0.5-1.0 and made from a composition containing by weight:
      70%-80% $Cr_2O_3$;
      20%-30% potassium dichromate; and
      2%-4% ammonium silicofluoride;
   3) coating the surfaces of the article from step 2 with a silicon-chromate coating by contacting said surfaces with an aqueous solution having a pH in the range of about 1.2 to about 1.9 at about ambient temperature for a time up to about 12 minutes;
   4) rinsing the coated article in a water bath at a temperature in the range of about 110° F. to 160° F. for a time sufficient to raise the temperature of said article to about the temperature of said rinse solution;
   5) contacting the rinsed coated article from step 4 with an aqueous alkaline solution having a pH of about 11-12 at a temperature of about ambient to about 130° F. for about ½ to about 2 minutes, said solution made up from a composition containing $SiO_2$ and $Na_2O$ in a weight ratio of $SiO_2/Na_2O$ of 2.4 to 3.25 and a density in the range of 40 to 52 degrees Baume' at 20° C.;
   6) drying in either ambient air or at a low temperature furnace at 150° F. to 200° F. for 1 to 2 minutes.

2. A method as claimed in claim 1 wherein the solution in step 3 has a pH less than 1.5 and the time of contact is less than 2 minutes.

3. A method as claimed in claim 1 wherein the solution in step 5 has a pH in the range of 11.2-11.5 and is made up from a composition containing in weight percent $SiO_2$ in the range of about 27.7% to about 31.7% and $Na_2O$ in the range of about 8.6% to about 11% at densities in the range of about 40 to 47 degrees Baume' at 20° C.

4. A method as claimed in claim 1 wherein the solution in step 5 has a pH of about 10.5 and is made up from a composition containing a weight ratio of $SiO_2/Na_2O$ of about 2.9 and a density of about 47 degrees Baume' at 20° C.

5. A method for providing a colorless coating on an article wherein the coating has a thickness in the range of about 50 angstroms to about 2 microns, consisting essentially of the steps of:
   (a) forming a first adherent surface coating on the surface of said article;
   (b) admixing with water, to form a bath solution, an admixture having the composition as follows, expressed in percent by weight of the final bath composition:
      (i) a water glass complex including: $Na_2O$ in an amount of about 0.44% to about 0.82%; $SiO_2$ in an amount of about 1.27% to about 2.37%; and $H_2O$ in an amount of about 2.29% to 4.25%;
      (ii) $MoO_3$ in an amount of about 0.1% to about 1.0%; and
      (iii) $LiOH.H_2O$ in an amount of about 0.1% to about 1.0%; and
   (c) contacting said article with said bath solution of step (b);
   (d) drying in either ambient air or at a low temperature furnace at 150° F. to 200° F. for 1 to 2 minutes.

6. A method as claimed in claim 5 wherein said $Na_2O$ of said water glass complex is present in an amount of about 0.63 percent, said $SiO_2$ of said water glass complex is present in an amount of about 1.82 percent, said water of said water glass complex is present in an amount of about 3.27 percent; said $MoO_3$ is present in an amount of about 0.5 percent; and said $LiOH.H_2O$ is present in an amount of about 0.5 percent.

* * * * *

UNITED STATES PATENT AND TRADEMARK OFFICE

CERTIFICATE OF CORRECTION

PATENT NO. : 5,219,617

DATED : June 15, 1993

INVENTOR(S) : Howard, et al

It is certified that error appears in the above-indentified patent and that said Letters Patent is hereby corrected as shown below:

On the Title Page after Foreign Patent Documents, insert the following heading and information:

--Other Documents--

--Patent Abstracts of Japan Vol. 8, No. 98 (c-221), Japan 59,013,078--

Column 4, line 19, "0 5" should be --0.5--.

Column 5, line 32, after "alloy" insert --.--.

Column 5, line 35, after "alloys" insert --.--.

Column 7, line 18, after "trials" insert --.--.

Column 8, line 11, "3 27" should be --3.27--.

Column 9, line 43, "20%" should be --2%--.

Column 10, line 29, "Cast" should be --cast--.

Signed and Sealed this

Thirty-first Day of May, 1994

*Attest:*

*Attesting Officer*

BRUCE LEHMAN

*Commissioner of Patents and Trademarks*